US010264867B2

(12) United States Patent
Lawrence

(10) Patent No.: US 10,264,867 B2
(45) Date of Patent: Apr. 23, 2019

(54) METHOD AND APPARATUS FOR NAIL FOIL ADORNMENT, REPAIR, PROTECTION AND STRENGTHENING OF THE NAILS' PLATE OF THE FINGER OR TOE

(71) Applicant: Ivy Lawrence, Las Vegas, NV (US)

(72) Inventor: Ivy Lawrence, Las Vegas, NV (US)

( * ) Notice: Subject to any disclaimer, the term of this patent is extended or adjusted under 35 U.S.C. 154(b) by 328 days.

(21) Appl. No.: 14/882,191

(22) Filed: Oct. 13, 2015

(65) Prior Publication Data

US 2016/0106193 A1 Apr. 21, 2016

Related U.S. Application Data

(60) Provisional application No. 62/066,861, filed on Oct. 21, 2014.

(51) Int. Cl.
*A45D 29/00* (2006.01)
*A45D 31/00* (2006.01)

(52) U.S. Cl.
CPC ..... *A45D 29/001* (2013.01); *A45D 31/00* (2013.01); *A45D 2029/005* (2013.01); *A45D 2029/008* (2013.01); *A45D 2200/25* (2013.01)

(58) Field of Classification Search
CPC ..... A45D 29/001; A45D 2029/005; A45D 2029/008; A45D 31/00
See application file for complete search history.

(56) References Cited

U.S. PATENT DOCUMENTS

| | | | | |
|---|---|---|---|---|
| 4,600,030 | A * | 7/1986 | Newman | A45D 31/00 132/320 |
| 5,415,903 | A * | 5/1995 | Hoffman | A45D 29/001 428/15 |
| 6,296,836 | B1 | 10/2001 | Engler | |
| 7,861,730 | B2 | 1/2011 | Jordan | |
| 8,092,786 | B2 | 1/2012 | Park | |
| 2005/0150508 | A1* | 7/2005 | Downs | A45D 29/001 132/73 |
| 2013/0032163 | A1* | 2/2013 | Roescheisen | A45D 29/001 132/200 |
| 2013/0220355 | A1* | 8/2013 | Park | A45D 29/001 132/73 |
| 2014/0326266 | A1* | 11/2014 | Park | A45D 29/001 132/200 |

* cited by examiner

*Primary Examiner* — Ryan A Reis

(57) ABSTRACT

The invention provides a nail foil adornment method and apparatus which cosmetically strengthens, fills, protects and repairs imperfections on natural or artificial nail plates. The adornment apparatus is comprised of two non-thermal flexible adhesives, color or pattern polyester Mylar foil film, opaque polyester Mylar film and clear nail polish. The method is comprised of brushed on transfer adhesive to the bare nail plate which dries clear, level and tacky (sticky). The color or pattern polyester Mylar foil film is digitally pressure transferred onto the nail plates dry tacky (sticky) surface. The used clear film carrier is discarded. The second flexible adhesive is applied to the foiled nail. The adhesive dries clear, tacky (sticky). The opaque polyester Mylar film is digitally transferred onto the nail plate creating a protection layer. The film carrier is discarded. The foiled nail is sealed with clear nail polish to extend wear.

7 Claims, 2 Drawing Sheets

METHOD AND APPARATUS FOR NAIL FOIL ADORNMENT, REPAIR, PROTECTION AND STRENGTHENING OF THE NAILS' PLATE OF THE FINGER OR TOE

BACKGROUND OF THE INVENTION

In the past 25 years the demand for artificial nail processes has grown exponentially in consumer acceptance with the consumer going to a nail salon or doing the processes at home. The initial expense of getting the nails done and the required 2-3 week expense to maintain the artificial nails cause a great majority of the consumers to take the artificial processes off of their nails. When the artificial processes are removed invariably there is damage to the nail beds from the drilling or filing and the chemical aids such as pure acetone and methacrylicate, thus leaving the nail beds generally thin, painful, brittle and unattractive in appearance. There are many products sold that are labeled as nail restoratives most of them clear nail polishes. The clear nail polishes vary in viscosity and how they dry onto the nail surface in many cases starting with a damaged uneven nail surface gives less than satisfactory results and very little protection to the damaged nail. The nail polishes being clear expose the wearer damaged and unattractive nails while waiting for regeneration of the natural nail. The present invention seeks a better apparatus and method for strengthening, temporarily filling in the nails imperfections until the nail naturally regenerates while leaving the consumer an adorned undamage looking nails of the finger or toe.

1. FIELD OF INVENTION

The present invention relates in general to applying a nail foil method and apparatus onto the nail of the finger or toe while adding protection, repair and strengthening to the nail plate of the finger or toe. This method and apparatus requires no external thermal heat sources (hair dryer, heat gun, special heat lamps, heaters, UV and LED lamps).

2. DESCRIPTION OF THE PRIOR ART

Nails are known in the related art. Nails usually consist of a hardened keratin protein typically formed by a mammal's body commonly known as a nail of the finger or toe. Damage to a persons natural keratin nail plate can be sustained from using a drill, file or abrasive. The process of applying and removing of artificial nail preparations (acrylic nails, fiberglass nails, linen or silk wraps, gel nails, nail tips) or the use of chemical preparations (harsh chemicals and alkalis) produce brittle and thin nail plates. Life events such as injuries, stresses and aging to the nail of the finger or toe leave the nail susceptible to weakened, thin nail plate surface, with valleys, depressions, splitting as well as tearing at the nail tip.

Nail polishes are known in the related art. Nail polishes vary widely in viscosity, pigment colors and brush sizes thus giving the user a less than uniform application experience. Conventional nail polishes often due to there lack of uniformity can result in poor color resolution, streaks and a general uneven finish. Due to variances in brush sizes and viscosity of conventional nail polish fine design and details are difficult to achieve. While it is the standard practice to use conventional nail polish on damaged nails, this process offers the nail of the finger or toe no additional strengthening. In fact, the colored nail polish will telegraph any split or uneven keratin nail plate layers. However, the nail's appearance while colored is not cosmetically improved in appearance.

Nail foils are known in the related art, some of which include: U.S. Pat. No. 4,600,030 (Newman), U.S. Pat. No. 6,296,836 (Engler), U.S. Pat. No. 6,516,813 (Yiu), U.S. Pat. No. 7,861,730 (Jordan), U.S. Pat. No. 5,209,250 (Traeckens), U.S. Pat. No. 5,415,903 (Hoffman et al) U.S. Pat. No. 8,092,786 (Park). Nail foils vary in how they are supplied to the end user as well as the skill level in application (licensed manicurist or over the counter customer). Nail foils are provided in varying size length and widths in sheets and rolls, as well as predetermined size self adhesive nail polish stickers. Heat-activated nail foils are known in the related art. (Jordan) Heat-activated or thermal activated nail foils in the related art typically require heat to activate the adhesive. Such heat based nail foils require the use of a heat gun, hair dryer, heat lamp, friction or other heat source. When using any external heat source it diminishes the protective nail oils surrounding the cuticle, matrix and nail plate causing the nail to become dry, brittle, thin and soft. The handling of a heat source can be awkward when a person wants to do their dominant hand. For some heat activated foils a person must be certified by the manufacturer such as a licensed manicurist or cosmetologist. Conventional heat based nail foils are applied directly to the nail of the finger or toe. Nail polish strips, nail shields and nail polish stickers are also known in the related art. Nail polish strips, shields and stickers are self adhering lacking a barrier of protection on the nail surface and are typically applied directly to the nail of the finger or toe. Nail polish shields, stickers or strips require abrasives, (buffers and files) and in some cases chemicals to facilitate application onto the nail of the finger or toe. Sources of dry heated air such as hair dryers, heat guns, heaters or special heat lamps are used in the application and removal of nail shields (a non exhaustive example of a nail polish shield is Jamberry Nail Shields). These heat sources promote damage to the cuticle and nail of the finger or toe allowing the nail to sustain brittle splitting and color change (yellow) to the nail surface. Cuticles become dry, less supple producing tears sometimes referred to as hangnails. Nail polish shields or similar products require the use of chemical aids (alcohol, oil free industrial acetone and acetone nail polish remover) to prepare the nail of the finger or toe for application of the pressure sensitive adhesive used to bond the nail shield to the nail of the finger or toe. Chemical aids are harmful to the cuticle and nail plate of the finger or toe and have known cancer causing agents. The use of abrasives on the nail of the finger or toe (buffers, files, drills) causes damages such as thinning, fracturing and splitting. The nail shields are furnished in assorted sizes. The user in this method of application has to select the size that is closest to the natural or artificial nail of the finger or toe. The nail polish strips, nail shields and nail polish stickers need to be fitted as closely as possible to the cuticle and nail tip to prevent the pressure sensitive adhesive from lifting off the nail of the finger or toe. Great care needs to be taken not to touch the pressure sensitive adhesive as the natural oil from your fingers can ruin the bond of the adhesive. After fitting the nail shield, nail strip or nail polish stickers the user has to cut, stretch and file to match the length and contours of their nail plates. For individuals who are not manicurists or ambidextrous filing, stretching and cutting with their non dominant hand presents a less then perfect nail in most cases. The self adhesive nail strips, nail shields and nail polish stickers come in a variety of thicknesses ranging from 25 microns to 50 microns of flexible vinyls and similar materials. Due to the bonding properties and thickness of the nail shields, nail polish strips and nail stickers a common problem is lifting off the cuticle edge and nail tip from everyday wear, hand washing, and coating with clear nail polish. The nail shields, nail strips, and nail polish stickers conceal a damaged nail plate but offer no strengthening. The damaged nail plate in many instances due to the use of abrasives and chemicals can damage the nail plate further. Furthermore, imperfections caused by abrasives and chemicals create nail valleys or ridges which can trap moisture and can create an opportunistic area for fungus or mold to evolve. Sally Hansen nail polish strips are a non-exhaustive example of a nail polish strips. Essie Nail Polish Stickers are a non-exhaustive example of nail polish stickers.

Therefore, it can be said that there is a need for a nail foil method and apparatus such as specified in the present invention that does not require an external heat source and facilitates an easier application process onto the nail of the finger or toe as well as require no special cutting, stretching, filing, buffing or chemical preparation. Finally, it can be said that there is a need to address any combination of the above.

SUMMARY OF THE INVENTION

To minimize the limitations in the prior art, and to minimize other limitations that will become apparent upon reading and understanding the present specification, this specification discloses a method and apparatus for cosmetically, beautifying, strengthening, adorning, temporarily repairing and protection on a nail of the finger or toe by providing an application comprised of a brush on color tinted self leveling tacky (sticky) adhesive, a color or pattern polyester Mylar foil film, opaque polyester Mylar film, and a clear nail polish for extended wear. The brush on color tinted adhesive is applied directly onto the nail. The unique, properties of the color tinted adhesive facilitates the nails' ability to regenerate and heal while creating a flexible bond on the nail plate. The color tinted adhesive dries to a clear, level, tacky (sticky) surface. The pliable polyester Mylar foil film which consists of a color or pattern and a carrier is placed, contoured and pressed sometimes referred to as a transfer medium onto the nail by use of a finger digit (thumb, index, middle, ring or pinkie) or any smooth edged implement (orange wood stick or plastic cuticle pusher) releasing the foil film color or pattern onto the nail tacky (sticky) surface. The remaining polyester Mylar foil film carrier is lifted off the nail which has now devoid of color or pattern. The clear film portion of the polyester Mylar foil film is discarded. These layers add a flexible strengthening to the keratin nail surface. The second coat of brush on color tinted adhesive is reapplied to the nails foiled color or pattern surface. The color tinted brush on adhesive dries to a clear, level, tacky (sticky) nail surface interlocking the polyester Mylar foil film color or pattern to the nail plate. The opaque polyester Mylar film is applied to the adhesive nail contouring and pressing onto the nail with a digit of the hand or any smooth edged implement releasing and transferring the opaque portion of the polyester Mylar film. The cleared opaque polyester Mylar film carrier is discarded. The opaque polyester Mylar film protects and prevents the transferred foil color or pattern from obliteration, cracking, crystallization, discoloration, wrinkling, and etching when sealed with a clear nail polish. This application of the adhesive and opaque polyester Mylar film protects and prevents the etching, wrinkling, obliteration, crystallization, lifting, discoloration and cracking caused by one or more of the detrimental chemical elements (alcohol, citric acid, butyl or ethyl acetate and nitrocellulose) contained in all clear nail polishes. This novel use of the opaque polyester Mylar film and the adhesive facilitates the protection to the adorned color or pattern while preserving the color or pattern registration.

The removal of the method and apparatus of the present invention is easily accomplished with non-acetone polish remover and a cotton ball and or cosmetic sponge or other similar device.

THE EMBODIMENTS OF THE PRESENT INVENTION

The following aspects are non-exclusive and are not always required of all embodiments and are provided herein as non-limiting illustrations to better understand the present invention.

An aspect of the present invention is to provide an easy contour fitting to the nail of the finger or toe regardless of shape or length, while strengthening and temporarily repairing the natural or artificial nail plate.

An aspect of this invention can be to provide a safer application process for nail color adornment including having no toluene, no DPB, no camphor, no acetone, no alcohol, no ultraviolet or LED, no ultraviolet heat sources, no thermal heat sources (hair dryers, heat guns, heat lamps, or heaters) no known cancer causing agents and no animal testing for the health and environmentally concerned consumer.

An aspect of this present invention can be to provide a nail foil adornment method and apparatus that is safe and easy to use for any consumer requiring no filing, no buffing, no cutting, no shaping no stretching or chemical preparation to the nail plates surface.

An aspect of this present invention can be to provide a polyester Mylar foil film without any need for a dry heat source (hair dryer, heat gun, heater, U.V. or LED lamp, special heat lamp or any other external thermal activation device). The flexible color tinted brush on adhesive is designed to air dry on to the nail without any external heat source. The color or pattern polyester Mylar foil films and the opaque polyester Mylar film in conjunction with the adhesive needs no external heat source to transfer onto the nail of the finger or toe. Because no heat is used in this process the cuticle to nail free edge will not develop cracked or torn skin known as hangnails.

An aspect of this present invention is to provide a nail foil transfer that is more durable and will not lift, chip, rub off, scratch, etch, discolor, crystallize, distort the color or pattern, wrinkle, disintegrate, obliterate or crackle the polyester Mylar foil pigment or metallic color, polyester Mylar foil hologram, pattern or design when sealed with clear nail polish for extended wear.

An aspect of this present invention is to provide a nail foil color or pattern that will not lift off the nail plate or peel up off the nail plate until its removed by the end user with any commercially available non-acetone nail polish remover.

An aspect of this present invention is the ability to offer high quality color prints, holographic and prismatic designs or patterns that anyone can apply.

An aspect of this present invention is to offer a chip free and streak free alternative to nail polish.

An aspect of this present invention is to offer a faster alternative for manicure or pedicure color polish applications. The foil application dries faster and is self leveling in a single application onto the nail of the finger or toe.

An aspect of this present invention is by use of the color tinted flexible adhesive on the natural or artificial nail of the finger or toe the adhesive adheres, bonds and temporarily repairs damaged nails. The adhesive provides a nail plate strengthener for natural or artificial nails. An aspect of this present invention provides a nail foil method and apparatus that temporarily repairs damaged nails while cosmetically covering them while the natural nail regenerates.

An aspect of this present invention can be to provide greater variety, selection and higher distinction by providing a medium which can facilitate non-utility (decorative) aspects while benefiting from enhanced protection.

An aspect of this present invention is to provide better protection of the color or pattern transferred to the natural or artificial nail plate. The thin six micron depth of the method and apparatus eliminates chipping, rubbing and lifting off of color from the nail plate. The nail shields, nail polish strips, nail polish stickers and nail polish have a higher incidence of lifting off, rubbing off and chipping due to their 25-50 micron depth.

An aspect of this present invention is to provide a method comprised of a flexible color tinted adhesive and opaque polyester Mylar film which enables the user the ability to apply a protective clear nail polish coat onto the nail to extend wear that will not detrimentally effect the color or pattern of the polyester Mylar foil film transfer on the nail of the finger or toe plate as previously noted in the summary of the invention. The description of the preferred embodiments is to be understood as non-limiting examples of the present invention. The true scope of the invention is to be understood by the claims and not limited by the preferred embodiments.

BRIEF DESCRIPTION OF THE DRAWINGS

Unique features and advantages of the present invention, in addition to those mentioned above, will become apparent to those skilled in the art from reading the following detailed description in conjunction with the accompanying drawings wherein.

DETAILED DESCRIPTION OF THE INVENTION

Figure 2:
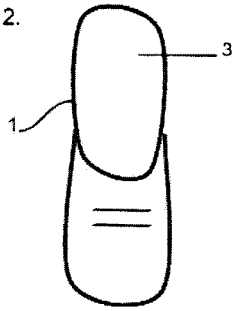
FIG. 2: Shows the application of color tinted adhesive onto the nail of the finger or toe filling in ridges and leveling any imperfections on the nail plate.

Referencing FIG. 2: The nail plate of the finger or toe 1 with imperfections 2 on the nail plate 1. The digits of the thumb, index, and pinkie of hand 5 is brushing a coat of flexible tinted color adhesive 3 (approximately 2 microns in depth) onto the nail plate 1 from the cuticle to the nails free edge which provides full coverage over the entire nail plate of the finger or toe 1 covering any imperfections 2 on the nail plate 1. Referencing FIG. 3: The adhesive 3 has air dried on the nail from color tinted to clear, level, tacky (sticky) surface creating a flexible 2 micron bond on nail plate 1 and filled in any imperfections 2 that could telegraph 1.

Figure 1:
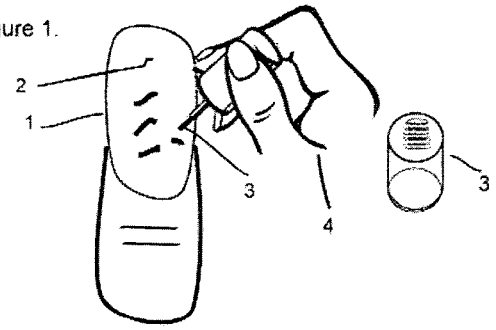
FIG. 1: Shows the components comprised of non-toxic adhesive bottle and brush, a clear nail polish bottle and brush, a sheet of color or pattern polyester Mylar foil film and a sheet of the opaque polyester Mylar film.
Figure 3:
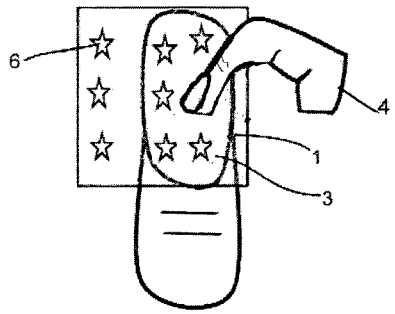
FIG. 3: Shows the non heat activated drying of the adhesive which has filled in any imperfections creating a clear, level, tacky (sticky) surface on the nail plate of the finger or toe.
Figure 6:
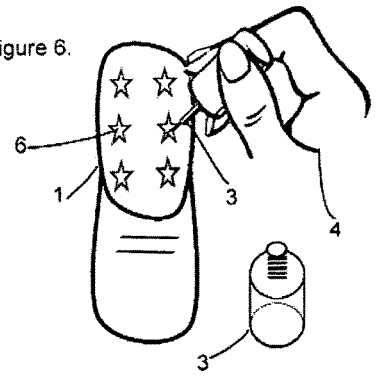
FIG. 6: Shows the reapplication of the brush on adhesive onto the transferred color or pattern of the polyester Mylar foiled nail of the finger or toe.

The adhesive FIG. 1, 3 and FIG. 6, 3 consists of a 100% water miscible base with a specific gravity (water=1) 1.10+/−0.10 with a vapor pressure of 700 mm HG@ 212° F., Evaporation Rate (Water=1) 1. Besides water, the adhesive is polyvinyl acetate, a polymer, made up of vinyl acetate repeating units. The adhesive is color tinted and has a slightly pungent odor, No CAS materials are used in the manufacturing process of this adhesive. The HMIS information of the adhesive is Health: 1, Flammability: 0, Reactivity: 0, Personal Protection: 1. When handling this adhesive good personal hygiene, such as washing your hands with soap and water prior to eating should be practiced.

Figure 4:
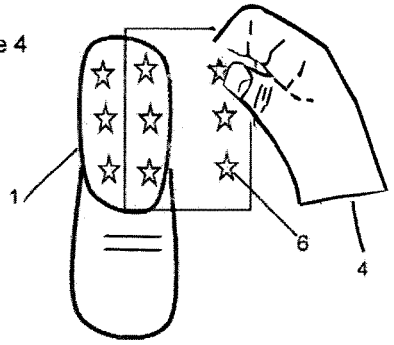
FIG. 4: Shows the smooth placement, contouring and direct contact of the color or pattern polyester Mylar foil film sheet onto the clear, tacky (sticky) nail plate of the finger or toe with any finger digit (thumb, index, middle, ring or pinkie).

The color or pattern of the polyester Mylar foil film FIG. 4: 6 is an innocuous material which presents no health hazards to the user. The color or pattern polyester Mylar foil film FIG. 4: 6 consists of the following components:

1 The polyester film carrier: The thinner the carrier while all other things being equal, the easier the foil will transfer.

2 The Release Coat: The composition of the release on the film carrier facilitates the transferred color or pattern. FIG. 4: The release is accomplished by applying direct contact with the dry clear, level, tacky (sticky) adhesive 4 nail plate of the finger or toe 1 with digit (index finger) 5 or a smooth edged implement plastic cuticle pusher or orange wood stick) with no thermal heat source.

3. A Lacquer, Tie or Color Coat provides a hard abrasion resistant surface to the foil when applied and carries the color tint in the form of pigments or dyes which is required to make gold or other colored aluminiferous because the metallic layer is always made from aluminum.

4 The Metal Coat: Generally composed of aluminum to provide the reflective qualities and opacity desired in metallic foils.

5 The Sizing Coat The final layer in the foil construction is the sizing which serves to bond the foil to the tacky (sticky) nail surface that's transferred to the nails surface.

The foil is an extremely thin polyester film material containing a dry pigment that is transferred onto the nails as referenced in FIG. 4 by the use of adhesive and digit (thumb, index, middle, ring, or pinkie) of the hand. This is a direct bond of the polyester Mylar film color or pattern 6 to the dried adhesive 4 that is clear, level, tacky (sticky) nail plate 1. The polyester color Mylar foil film referencing FIG. 1: 6 and the opaque Mylar film FIG. 1: 8 is generally available on rolls from 24" to 72" wide ranging from 200 feet to 1000 feet in length and 15-30 microns in thickness.

In order to provide for easier handling for the consumer, the rolls are slit to the desired application widths for nail of the finger or toe of the consumer. The polyester Mylar foil film and opaque polyester Mylar film is cut from ½" wide to 6" wide. Since 200 feet to 1,000 feet lengths would be cumbersome for the consumer to handle the colored or pattern foil film and opaque Mylar film is unrolled and precision cut to 4"-8" in length and any combination of the above mentioned widths. The precision cutting is accomplished by unrolling polyester Mylar films (color, pattern or opaque) and is fed through a mechanically driven guillotine cutter to sheet it without damaging the films. The Polyester Mylar films also can be provided in 5 feet-25 feet rolls or strips in various widths. The consumer has a hard time using rolls or strips due to the fact the films have to be cut. Cutting the polyester Mylar films with conventional tedious methods (scissors or paper cutter or razor knife) can leave less then a desirable result such as damaging the release coat, wrinkling, ripping and uneven edges. One other factor of the roll; it likes to unroll and generally gets damaged when the consumer attempts re-rolling.

FIG. 4: References placing the color or pattern polyester Mylar foil film sheet 6 onto the nail plate 1 of the finger or toe over the dried, clear, level, tacky (sticky) adhesive 4 on the nail plate 1. You may use all or any portion of the color or pattern sheet 6. The user will place their digit 5 (example index finger) over the color or pattern polyester Mylar foil film 6 to ensure it has complete contact with the nail plate surface 1 of the finger or toe. The dried clear, level, tacky (sticky) adhesive 4 creating a complete transfer bond of color or pattern 6 approximately 1 micron in depth over the 2 micron dried, clear, level, tacky (sticky) adhesive 4 nail plate 1 totaling 3 microns.

Figure 5:
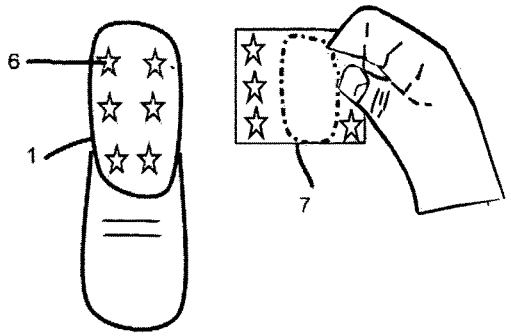
FIG. 5: Shows the lifting of the color or pattern polyester Mylar foil film sheet off the nail of the finger or toe and the color or pattern has transferred. This shows the color or pattern polyester Mylar foil film remaining on the nail plate of the finger or toe and the polyester Mylar foil film carrier is devoid of color or pattern where transferred onto the nail plate. When there is no longer any color or pattern on the polyester Mylar foil film sheet it is no longer useable. The remaining clear film carrier is discarded.

FIG. 5: References the removal of the 14 micron polyester clear Mylar film carrier 7 off the nail after the colored foil or pattern 6 has transferred to the dried, clear, level, tacky (sticky) adhesive 4 onto the nail plate of the finger or toe 1. The carrier 7 is lifted off the nail plate of the finger or toe by gripping the corner and lifting off with hand 5. This shows the color or pattern polyester Mylar foil film sheet 6 lifted totally off of the nail plate of the finger or toe 1. The dotted cleared carrier film Section 7 represents the color or pattern polyester Mylar foil film color 6 that has been transferred to the nail plate 1. The remaining color or pattern left on the polyester Mylar foil film sheet 6 may be used until completely devoid of color or pattern. The use of the disposable 14 micron clear polyester carrier 7 prevents indentations to the nail color or pattern 6 when using a digit 5 or any smoothing object.

FIG. 6: Shows the reapplication of adhesive 3. The digits of the thumb, index, and pinkie of hand 5 is brushing a coat of flexible tinted color adhesive 3 (approximately 2 microns in depth) onto the nail plate 1 from the cuticle to the nails free edge which provides full coverage over the entire nail plate of the finger or toe 1 covering the nail plate 1. over the entire previously transferred polyester Mylar color foil or pattern 6.

Figure 7:
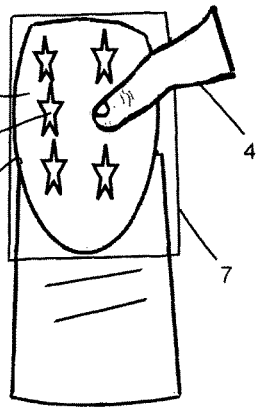
FIG. 7: Shows the adhesive has dried to a clear, level, tacky (sticky) surface where the previously foiled nail color or pattern is completely viewable under the coat of adhesive.

FIG. 7: The adhesive 3 dries 4 from a color tint to a clear, level, tacky, (sticky) nail surface over the color or pattern 6 will be clearly present.

Figure 8:
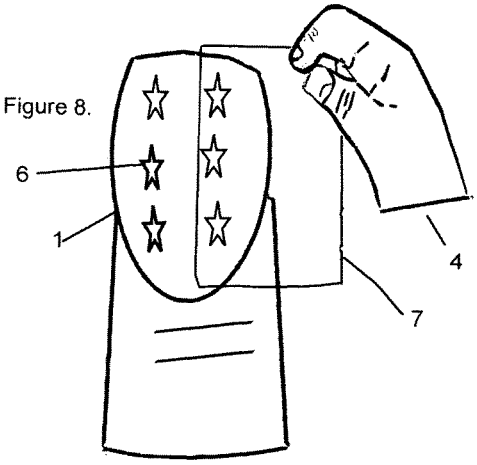
FIG. 8: Shows the digit (finger of the hand) pressing, directly contouring the opaque polyester Mylar film over the clear, tacky (sticky) adhesive on the previously transferred foil color or pattern on the nail plate surface of the finger or toe.

FIG. 8: Shows the application of the opaque polyester Mylar film sheet 8 over the dried, clear, level, tacky (sticky) adhesive 4 by pressing down over the tacky nail plate 1 with a digit (index finger) 5 that has direct contact with the dry clear, level, tacky (sticky) adhesive 4 and previously transferred polyester Mylar foil film color or pattern 6. This gives the Mylar foil color or pattern 6 an extra layer of protection from discoloration, scratches, wrinkling, etching, disintegration, obliteration, as previously referred to in the summary of invention. This step increases the strength and protection of the nail plate as previously referred to in the summary of invention.

The polyester Mylar film 8 is a 30 micron opaque film that has excellent resistance to moisture and most chemicals and can withstand temperature extremes from −70° C. to 150° C. It contains no plasticizers the polyester Mylar does not become brittle with age.

FIG. 8: The film transfers onto the nail surface 1 when placed on 4 the adhesives, dried, level, tacky (sticky) nail plate 1 releasing its protection layer 8 over the color or pattern polyester Mylar foil film 6. The transfer of the opaque polyester Mylar film 8 provides a protection layer that prevents the color or pattern from obliteration, etching of color, crackling of color, distortion of color patterns, removal of holographic patterns, and dulling when the nail is sealed with a chemically based clear nail polish to extend its wear.

Figure 9:
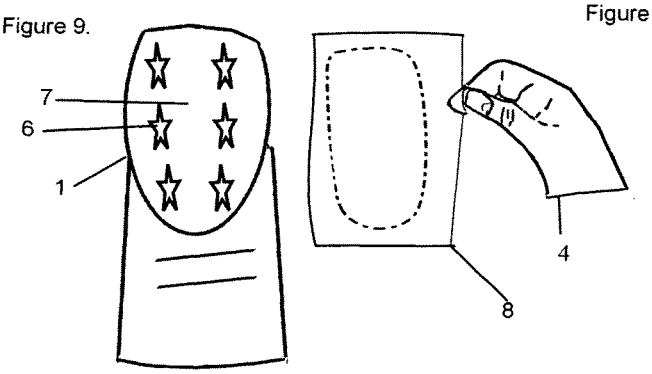
FIG. 9: shows the lifting off of the opaque polyester Mylar film from the nail of the finger or toe. The nail now has a transferred protective layer over the previously colored polyester Mylar foil as shown in the outline of the opaque Mylar film protection coat that has transferred onto the nail plate surface of the finger or toe and the clear carrier is discarded.

FIG. 9: The removal of the opaque Mylar film 8 after it has transferred its protective layer onto the previously colored foil pattern 6 nail plate 1 shows the cleared carrier 8 of the polyester Mylar film the clear outlined section of the carrier 9 shows the Mylar transfer 8 onto the nails foiled surface 6 on the nail plate 1. The hand 5 has lifted the remaining opaque polyester Mylar film 6. The opaque polyester Mylar film 8 is discarded as held by hand 5.

Figure 10:
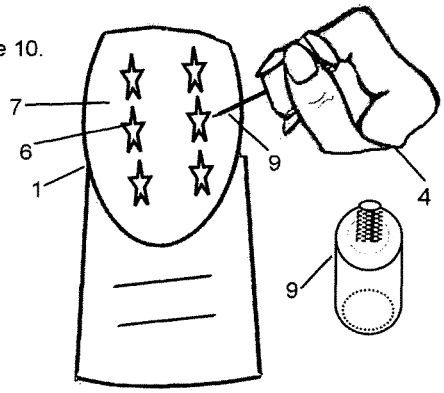
FIG. 10: Shows the brush on clear nail polish over the entire nail from cuticle to nails' free edge. This seals the four layers of the method and apparatus for extended wear by the user.

FIG. 10: Represents sealing the polyester Mylar foil color 6 and the opaque polyester Mylar film 8 using a brush 10-B in as applied by hand 5. The application of clear nail polish 10 sealing the entire nail plate 1 to extend wear by the user.

Figure 11:
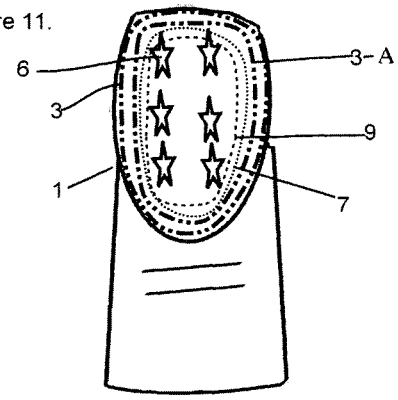
FIG. 11: Shows the completed view of the finished nail of the finger or toe.

FIG. 11: Represents the completed nail. It may be any type of natural, artificial nail, nail tip or nail extension whether damaged or undamaged. The nail decorating techniques discussed herein are with reference to nails of the finger or toe.

Figure 12:
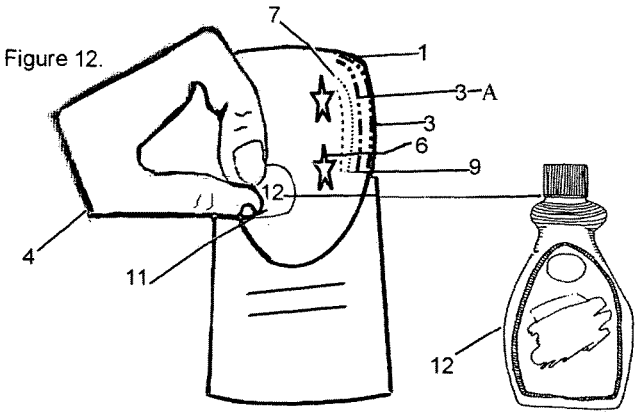
FIG. 12: Explains removal of the 5 layer sandwich process of the present invention method and apparatus comprised of clear nail polish, opaque polyester Mylar film, the second coat of adhesive, the color or pattern of the polyester Mylar foil film and the first coat of adhesive with nail polish remover and a cotton ball.

FIG. 12: Represents the easy removal of the clear nail polish 10, the opaque polyester Mylar film 8, the removal of the second coat of adhesive 3-C, the Mylar foil color or pattern 6, and adhesive 3 with any commercially available nail polish remover 11 shows a cotton ball 12 with nail polish remover 11 held by the hand 5 removing all of the layers of the 5 layer method and apparatus off of the nail plate 1.

Preferably in FIG. 2: The application of adhesive 3 to the fingernail plate 1 needs to be completely covered so the polyester Mylar Foil color or pattern film will achieve a full transfer onto the dried, level, tacky (sticky) adhesive FIG. 3: In referencing FIG. 2 by covering the nail plate 1 completely with the adhesive 3 any imperfections, valleys or depressions 2 will be filled in and made level to add strengthening and protection of the nail plate.

Conversely, if only a portion of the nail plate 1 was going to be colored as in the example of a French Manicure you would only brush on adhesive 3 where you chose to add color to the nail plate 1. The way the color or pattern Polyester Mylar foil film is offered in precision cut rectangles with 4 straight edges makes for an easily achievable French Manicure design or any other design requiring a straight edge.

In FIGS. 2, 3, 4 and 5. The method shows using 1 color or pattern of polyester Mylar foil film. You have the ability to use any combination of polyester Mylar foil films to create any design the user would like to execute. After lifting off the polyester Mylar foil films referencing FIG. 5. You may add additional colors by reapplication of adhesive over the transferred color of the polyester Mylar foils referencing FIG. 6 and letting the adhesive dry to a clear, level, tacky, sticky nail surface FIG. 7. The color or pattern polyester Mylar foil films are placed on the surface of the dry, clear, level, tacky (sticky) surface with a digit 5 or other smoothing object as shown in FIG. 4. The carriers from the polyester Mylar foil films would be lifted off the nail plate by gripping the corner with the index and thumb as shown in FIG. 5:

The lifted off used carrier 7 represents the transferred color or pattern polyester Mylar foil films. You would then reapply the adhesive over the previously foiled nail FIG. 6. The opaque polyester Mylar film 8 is placed and contoured with your digit 5 onto the foiled nail 6 to protect your design and strengthen the nail plate 1. FIG. 8. The carrier of the polyester Mylar film is discarded after transferring a protection layer 8 FIG. 9. To further extend the wear of the design you would use a coat of clear nail polish and let dry. FIG. 10.

Unlike conventional nail polish if you don't like the color or pattern you have transferred onto the nail it does not need to be removed with nail polish remover as shown in FIG. 12. The color or pattern polyester Mylar foil film FIGS. 2-5, affords you the ability to reapply the adhesive over the existing design FIG. 6 and select a different color of the polyester Mylar foil and repeat steps as illustrated in FIGS. 2-5.

The foil transfer process as shown in FIGS. 2-9. affords the user the ability to generate there own unique or uniform designs by placement of the adhesive to the section of the nail plate where the polyester Mylar foil color or pattern is desired. This allows for customization on the users part when choosing how to design or color the nail plate. Any combination of the above techniques may be used on each nail to create a unique long lasting and colorful design with a variety unavailable in the foils offered that are thermally activated or produced in an already pre-determined size of the finger or toe such as nail polish strip(s) nail shields and nail stickers. Furthermore, the finished nail FIG. 11: by use of our foil method and apparatus requires less up keep and unlike conventional nail polishes is less susceptible to chipping and cracking. The method affords the user a thin 6 microns total of transferred color, pattern or design of the polyester Mylar foil film in conjunction with 2 coats of flexible adhesive a layer of opaque polyester Mylar film and a clear nail polish sealer that is not found in other products.

FIG. 12 Shows the easy removal of the clear nail polish 10, opaque polyester Mylar film 8, second coat of adhesive 3-C, the colored polyester Mylar foil 6, removal of adhesive 3 with non-acetone nail polish remover 11 and a cotton ball 12 with polish remover 11. When the layers are removed it reveals the bare nail plate 1.

CONCLUSION

In summary, the present invention provides a method and apparatus for color or pattern polyester Mylar nail foil application which strengthens protects and temporarily repairs the nail plate of the finger or toe while the nail regenerates without the use of any external thermal dry heat source (hair dryer, heat gun, heater, heat lamp). This present invention provides a method of applying a protective flexible and pliable bond adhesive onto the nail plate. The flexible adhesive dries to a clear, level, tacky (sticky) approximately 2 micron coating on the nail plate facilitating the transfer of the selected color or pattern of the polyester Mylar foil film which leaves a 1 micron color layer on the adhesive nail plate of the finger or toe. The second coat of flexible adhesive when applied to the nail over the transferred polyester Mylar foil film thus it interlocks the now colored nail plate of the finger or toe. This application and transfer of the polyester Mylar film provides a protection coat that strengthens the nail of the finger or toe as well as preserving the original color and pattern registration when being seal coated with clear nail polish to extend its wear. This method is two (2) applications of adhesive and a color or pattern polyester Mylar foil film, opaque polyester Mylar film and clear nail polish. This creates a 5 layer sandwich method and apparatus which strengthens, protects, temporarily repairs the damaged nails of the finger or toe and making them cosmetically appealing. This method and apparatus can be used on artificial, natural damaged or undamaged nail plates of the finger or toes with equally good results.

What is claimed is:

1. A method for nail foil adornment repair, protection, and strengthening the nail plate of the fingers or toes, comprising:

applying a first coat of colored brush on water miscible liquid repeating polyvinyl acetate adhesive to a nail plate or an artificial nail extension, wherein the adhesive is self-leveling and non-thermally polymerizes to a clear, tacky, shiny, strengthened, defect free surface;

applying a precision cut rectangular sheet of polyester Mylar foil film color or pattern onto the clear, tacky, shiny, polymerized surface of the nail plate using slight pressure;

lifting the sheet of polyester Mylar foil film completely off of the nail plate or artificial nail extension leaving a direct color or pattern adornment without a substrate or a plastic or polyester carrier remaining on the nail plate or artificial nail extension, wherein the color or pattern strengthens the nail plate or artificial nail extension in a non-tacky state;

applying a second coat of water miscible liquid repeating polyvinyl acetate adhesive directly on the color or pattern adornment, wherein the second coat polymerizes to a clear, tacky, shiny foil adorned nail surface;

applying a precision cut rectangular sheet of slightly opaque polyester Mylar film protection on the polymerized second coat using slight pressure;

lifting the sheet of slightly opaque polyester Mylar film completely off of the nail plate or artificial nail extension leaving a direct slightly opaque Mylar adornment without a substrate or a plastic or polyester carrier remaining on the nail plate or artificial nail extension of the finger or toe; wherein the polyester Mylar's unique tensile strength protects the nail plate providing a barrier from chemical or environmental elements, including but not limited to preserving the color or pattern from discoloration, water intrusion, and chemical intrusion; and applying a coat of nitro-cellulose clear nail polish for sealing and extending wear of the foil and Mylar adorned nail plate or artificial nail extension.

2. The method according to claim 1, wherein the application of the colored water miscible liquid repeating polyvinyl acetate adhesive when non-thermally polymerized on the damaged nail plate of the finger or toe fills in and self-levels any imperfections or valleys of the damaged nail plate of the finger or toe;

wherein no other chemical or mechanical preparation is necessary for the adhesive to re-link, and repair the damaged nail plate of the finger or toe.

3. The method according to claim 1, wherein the transferring of the polyester Mylar foil film color or pattern requires no cutting, shaping, sizing or stretching over the nail plate of the finger or artificial nail extension of the finger or toe, making for easy self-repairing and adorning right or left finger nail plates or toe nail plates or artificial nail extensions of the fingers or toes.

4. The method according to claim 1, wherein the slightly opaque polyester Mylar film transfer prevents the polyester Mylar foil film color or pattern adorned nail plate or artificial nail extension of the fingers or toes from color scratching off, etching, discoloration of the color or pattern, and obliteration of the color or pattern when sealed with nitro cellulose clear nail polish.

5. The method according to claim 1, wherein applying the coat of nitro-cellulose clear nail polish directly onto the slightly opaque polyester Mylar and the polyester Mylar foil color or pattern nail plate of the finger or toe extends wear and seals the entire nail plate with a clear finish.

6. A nail foil kit for nail foil adornment repair, protection, and strengthening of one or more nails of the fingers or toes comprising:

a bottle of colored water miscible liquid repeating polyvinyl acetate adhesive;

precision cut rectangular sheets of polyester Mylar foil film colors or patterns for direct transfer of nail adornments;

precision cut rectangular sheets of slightly opaque polyester Mylar film for direct transfer protection and strengthening of the adorned nail plate or artificial nail extension of the fingers or toes; and a bottle of clear nitro cellulose or water based nail polish for a final finish and extended wear.

7. The nail foil kit according to claim 6, wherein the colored water miscible liquid repeating polyvinyl acetate adhesive needs no thermal or external heat sources, fanning, Ultra Violet, LED or incandescent light sources to polymerize; and the colored water miscible liquid repeating polyvinyl acetate adhesive cures to a tacky, shiny, defect free, flexible adhesive layer on either damaged or undamaged nail plates or artificial nail extensions of the fingers or toes.

* * * * *